US007384344B2

(12) United States Patent
Aguirre

(10) Patent No.: US 7,384,344 B2
(45) Date of Patent: Jun. 10, 2008

(54) PHYSICAL CONDITIONING AID FOR GOLFERS

(76) Inventor: Sergio Aguirre, 9619 Berryville, San Antonio, TX (US) 78245

( * ) Notice: Subject to any disclaimer, the term of this patent is extended or adjusted under 35 U.S.C. 154(b) by 4 days.

(21) Appl. No.: 11/226,752

(22) Filed: Sep. 14, 2005

(65) Prior Publication Data

US 2006/0079344 A1 Apr. 13, 2006

Related U.S. Application Data

(60) Provisional application No. 60/609,932, filed on Sep. 15, 2004.

(51) Int. Cl.
*A63B 69/36* (2006.01)

(52) U.S. Cl. ..... 473/226; 473/219; 473/228; 473/256

(58) Field of Classification Search ..... 473/219, 473/223, 226, 228, 229, 256, 422, 451, 437; 482/109, 111; 244/142
See application file for complete search history.

(56) References Cited

U.S. PATENT DOCUMENTS

| | | | | | |
|---|---|---|---|---|---|
| 2,910,297 | A * | 10/1959 | Bonetate | ..... | 473/228 |
| 3,416,803 | A * | 12/1968 | Jose | ..... | 473/228 |
| 5,207,625 | A * | 5/1993 | White | ..... | 482/111 |
| 5,362,059 | A * | 11/1994 | Grossman | ..... | 473/228 |
| 5,803,838 | A * | 9/1998 | DeMarini et al. | ..... | 473/437 |
| 6,881,156 | B1 * | 4/2005 | Phillips | ..... | 473/228 |
| 2003/0207719 | A1 * | 11/2003 | Hughes | ..... | 473/228 |

* cited by examiner

*Primary Examiner*—Nini F. Legesse
(74) *Attorney, Agent, or Firm*—Jackson Walker, LLP

(57) ABSTRACT

A physical conditioning device for golfers is provided. A weight is attached to the tip of a standard golf club shaft to provide strength training for a the backswing portion of a golf swing. A drag chute is attached to the shaft to add resistance to the downswing of the golf swing to prevent the user from simply allowing the weight of the club to cause the club to drop with little physical effort. This combination of weight and drag chute provides an enhanced conditioning effect.

11 Claims, 5 Drawing Sheets

PHYSICAL CONDITIONING AID FOR GOLFERS

This application claims priority from U.S. Application No. 60/609,932 filed Sep. 15, 2004 and incorporates by reference the '932 application as if it were fully printed herein.

FIELD OF THE INVENTION

Applicant's invention relates to a physical conditioning device. More specifically, the present invention relates to a physical conditioning device to enhance the strength, stamina, and endurance of a golfer.

BACKGROUND OF THE INVENTION

Golf is one of America's most popular sports. According to the National Golf Association, more than 26.4 million individuals over the age of 12 played golf in 1999.

Although an athletic endeavor, few golfers are properly conditioned to play a complete round of golf. Most golfers succumb to some level of fatigue well before the end of a round.

There are many golf swing trainers in the marketplace which claim tremendous results through correct use on a consistent basis. While most of them have some merit and offer some benefits, they all can be generally categorized by one or more counterproductive deficiencies.

One category includes trainers that are solely unweighted in comparison to actual golf clubs. Since these trainers are not weighted, they neither communicate to the muscles of the golfer in such a way as to break down muscle tension and old muscle habits, nor develop the proper muscle memory needed to produce a correct golf swing. Furthermore, while some of these unweighted devices feel good to swing, they generally cause the golfer to swing the club over the top of the ball.

A second category employs swing guidance mechanisms such as hoops, tracks, belts and the like designed to force the golfer to swing an actual golf club or trainer on a supposed proper swing path. Such devices are generally quite complicated and require much time in setting up for the unique physical characteristics of each individual golf student. Since they do not involve weighted mechanisms, they neither break down old incorrect muscle memory nor build new correct muscle memory. Furthermore, these swing guidance mechanisms are generally based on the false premise that a golf swing takes place in a single plane. The golf swing is a bi-planar three-dimensional motion which known guidance mechanisms do not replicate.

A final category includes trainers which are improperly weighted, weighted by mechanisms that are hinged to the clubhead end of the shaft, or weighted through the use of a solid shaft composed of steel or other metal or a standard shaft filled with metal bearings, sand, or other material. While these trainers may increase strength if properly used, the use of weights alone allows the user to swing the training device with little physical effort on the down swing and thereby yield little results.

It is, therefore, an object of this invention to provide a swing trainer that may be weighted so as to break down muscle tension and old muscle habits but also includes a mechanism to discourage simple repetitive swinging of the trainer with little effort. Another object of this invention is to provide a golf swing trainer that requires no set up for a training session. A further object of this invention is to provide a golf swing trainer that readily fits in a golf bag with the golfer's other equipment. It is yet a further object of this invention to provide a golf swing trainer that can be used anywhere, indoors or outdoors, as a trainer or as a warm-up tool.

SUMMARY OF THE INVENTION

In accordance with the invention, a golf swing trainer is provided which consists of a typical golfclub shaft constructed of either steel or graphite. In one embodiment, the butt end of the shaft is fitted with a standard golf club grip. In alternate embodiments, the grip may be formed to encourage proper gripping of the club by the user.

The tip end of the shaft may be fitted with a weight. The weight may be permanently affixed to the shaft or may be removable and exchangeable to allow for varying the weight attached as the golfer becomes more conditioned. The weights may be coated with rubber or other energy absorbent material to afford protection for walls, floors, furniture, and people.

Typically, the trainer will be in the range of 30" to 45" in length and with a diameter similar to a standard golf club shaft, approximately 0.335" to 0.620". The particular length and diameter is chosen to accommodate the size and strength of the golfer. In some embodiments, the shaft may be tapered.

A drag chute is attached to the shaft in at least one point. In some embodiments, the drag chute may rotate about the longitudinal axis of the shaft to allow the drag chute to automatically align itself during the swinging motion to provide maximum resistance. The drag chute may be constructed of nylon, cotton, polyester, or any other low-stretch fabric. The drag chute is adapted to capture air as the user swings the trainer and thereby increase the resistance of the trainer as it travels. The drag chute may be ribbed with elastic material to allow the drag chute to expand when the club is in motion and thereby increase the resistance. The drag chute may be rectangular, triangular, circular, ovate, or any other shape capable of capturing air to increase resistance.

DETAILED DESCRIPTION OF THE PREFERRED EMBODIMENT

Figure 1:
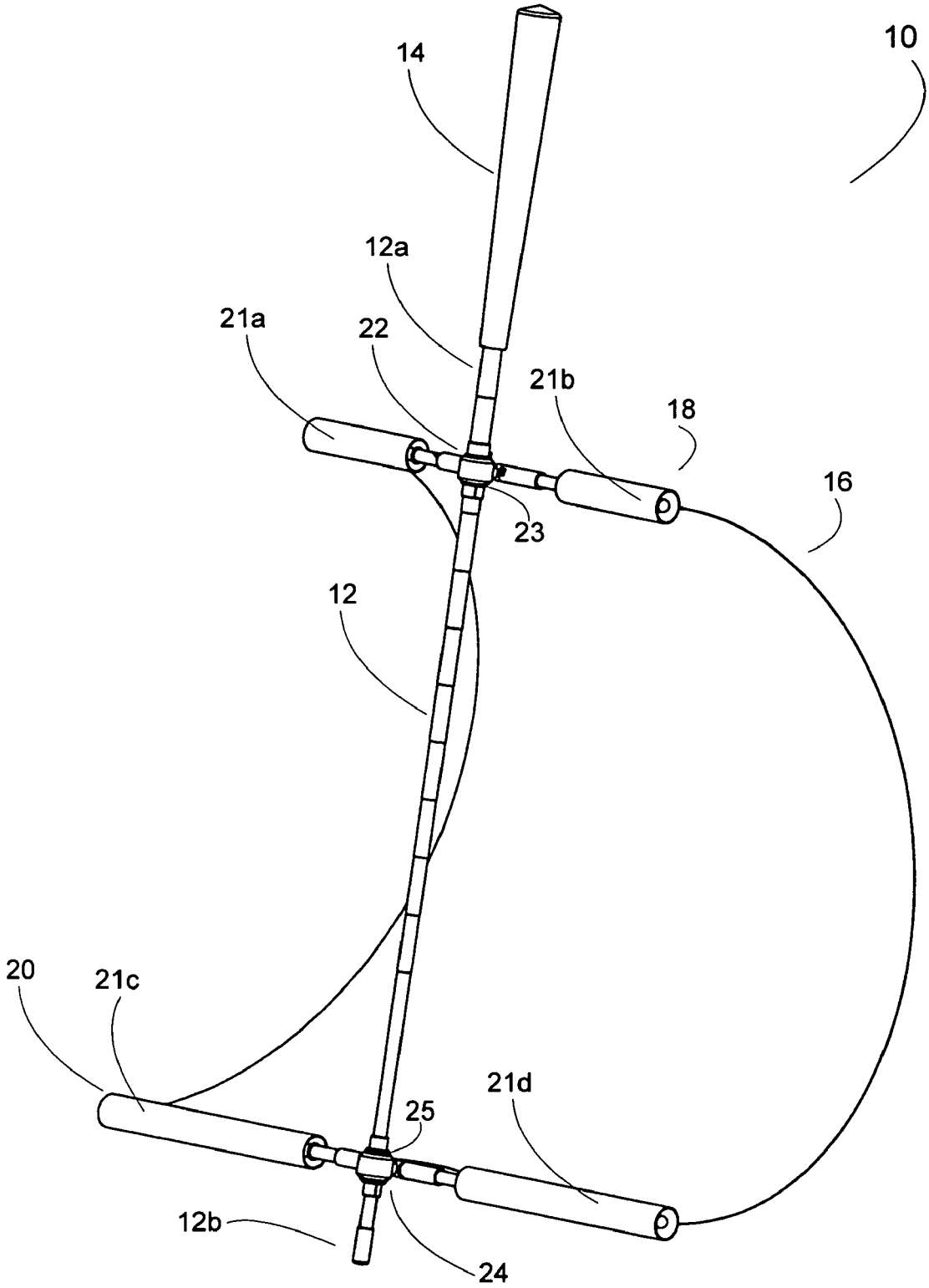
FIG. 1 is a perspective view of a first embodiment of the present invention.

Referring to the figures in which like referenced features indicate corresponding elements throughout the several views, attention is first directed to FIG. 1 which illustrates a first embodiment of a golf physical conditioning device (10). At one end of the shaft (12) can be seen the grip (14). The shaft (12) may be composed of steel, aluminum, graphite, or any other rigid material capable of withstanding the forces applied thereto during the swinging motion. The length of the shaft (12) may be between 30 inches and 45 inches. Generally, the shaft (12) will extend the entire length of the physical conditioning device (10). The grip (14) may be a standard golf club grip such as the Golf Pride® Tour Velvet® Half Cord which is inserted over the butt end (12*a*) of the shaft (12). In an alternate embodiment, the grip (14) may be molded to encourage proper placement of the hands of the user on the grip (14). In another alternate embodiment, the butt end (12*a*) of the shaft (12) may be formed into the shape of a grip.

Figure 1A:
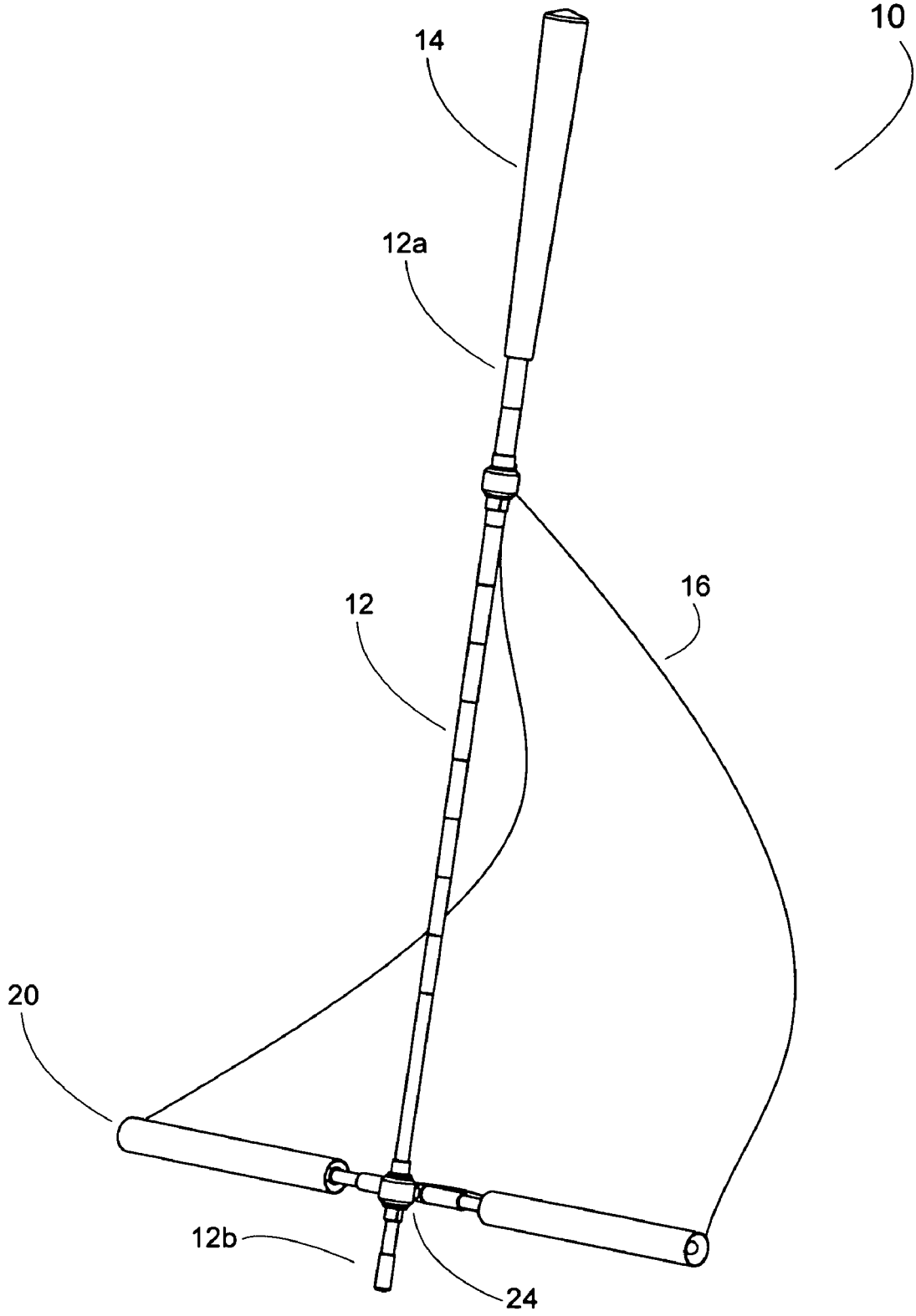
FIG. 1*a* is a perspective view of another embodiment of the present invention.

A drag chute (16) with a first end and a second end is shown. In one embodiment, the drag chute (16) is generally rectangular in shape. Referring to FIG. 1*a* it is seen that alternate shapes for the drag chute (16) are contemplated. Returning to FIG. 1., it is seen that there is an upper boom (18) and a lower boom (20). In the preferred embodiment, boom hubs (21*a*, 21*b*, 21*c*, 21*d*) are rotatably mounted upon the booms (18 and 20) with the drag chute (16) then attached to the boom hubs. In this configuration, as the drag chute (16) is filled with air, the hubs (21*a*, 21*b*, 21*c*, 21*d*) may rotate to relieve stress applied to the point where the drag chute is mounted to the booms (18 and 20). In other embodiments, the drag chute (16) may be attached directed to the booms (18 and 20). The upper and lower booms (18 and 20) are mounted to the shaft (12) in such a fashion as to allow the booms to pivot about the longitudinal axis of the shaft (12) to permit the drag chute (16) to remain properly aligned throughout the swing motion. The upper and lower booms (18 and 20) are also mounted to the shaft (12) in such a fashion as to allow the booms to pivot parallel the longitudinal axis of the shaft (12) to permit the booms (18 and 20) to be aligned substantially parallel to the shaft (12) to allow for convenient storage of the physical conditioning device (10). The capability of the upper and lower booms (18 and 20) to pivot both about and parallel to the longitudinal axis of the shaft (12) may be provided by upper boom mount (22) and lower boom mount (24), shown in greater detail in FIG. 4. To facilitate the rotational movement of the upper and lower booms (18 and 20), an upper bushing (23) and a lower bushing (25) may be disposed between the shaft (12) and the upper and lower boom mounts (22 and 24). The bushings may be composed of nylon, brass, or any other suitable material. In alternate embodiments, the convenient storage provided by parallel alignment of the booms (18 and 20) to the shaft (12) may be provided by folding the booms (18 and 20) at their point of attachment to the shaft (12).

Figure 2:
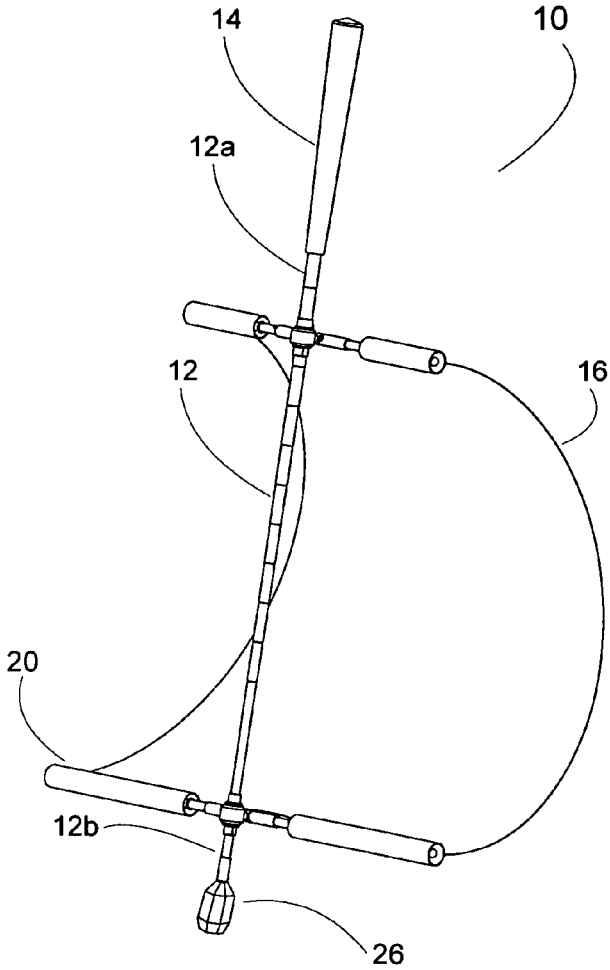
FIG. 2 is a perspective view of another embodiment of the present invention with a weight affixed to the tip end of the shaft.
Figure 2A:
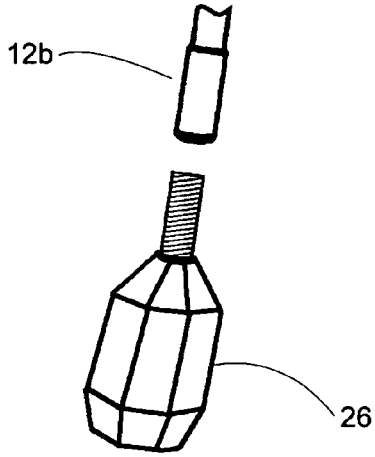
FIG. 2*a* is a partial perspective view of one method of affixing the weight to the tip end of the shaft.

Referring now to FIG. 2 in which it is seen the physical conditioning device (10) with a weight (26) attached to the tip end (12*b*) of the shaft 912). In the preferred embodiment the mass of the weight (26) is 16 ounces. However, the mass of the weight (26) may vary between 4 ounces and 32 ounces depending upon the current condition of the user and the work-out desired. In some embodiments of the physical conditioning device (10) the weight (26) is permanently affixed to the tip end (12*b*) of the shaft (12). As seen in FIG. 2*a*, it is also contemplated that the weight (26) may be removably attached to the tip end (12*b*) of the shaft 912). As seen in FIG. 2*a*, one method of removable attachment is the use of threaded engagement of the weight (26) with the tip end (12*b*) of the shaft (12).

Figure 3:
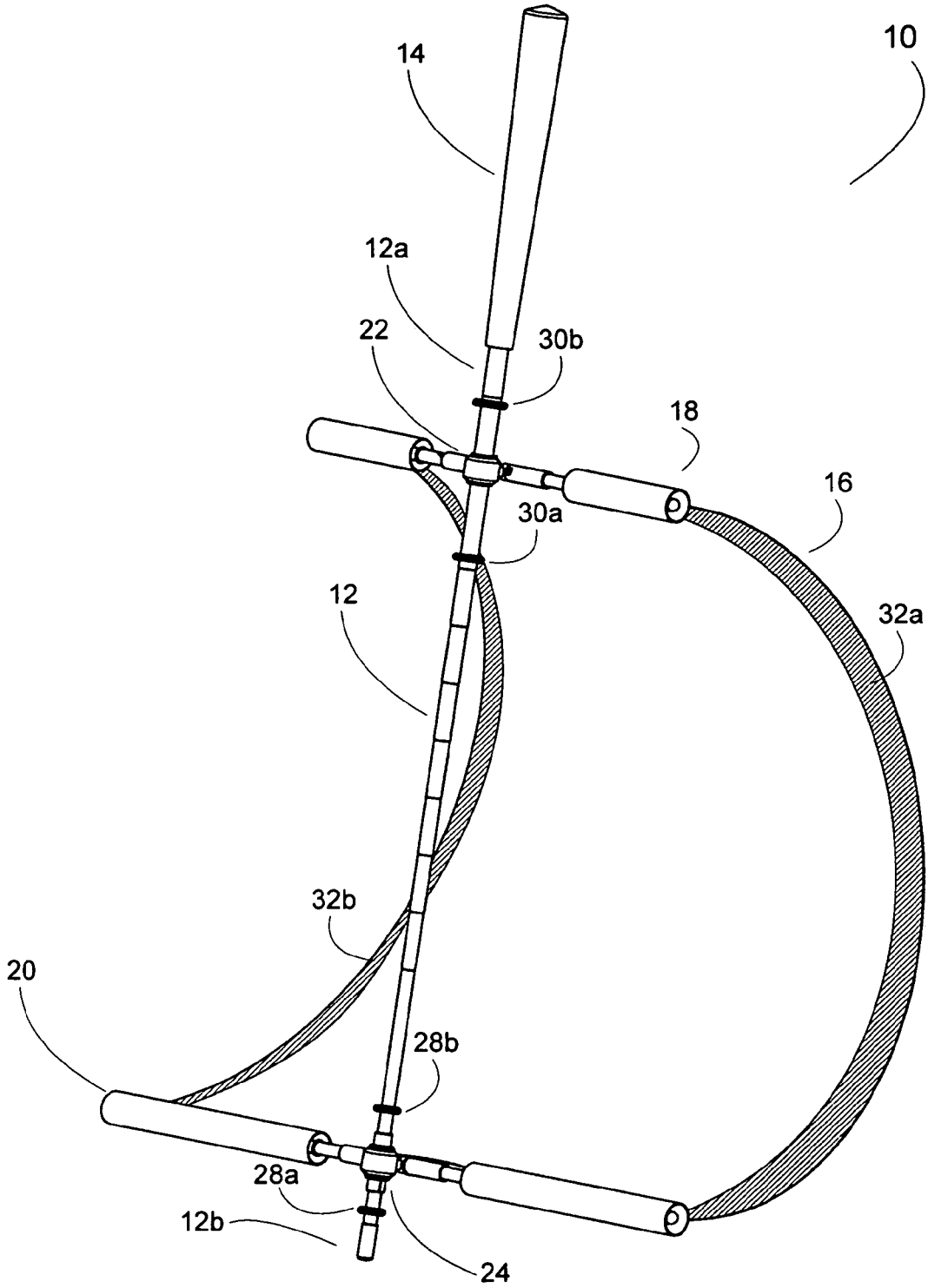
FIG. 3 is a perspective view of another embodiment of the present invention wherein the booms are adapted to slide along the length of the shaft via slidable engagement by the boom mounts.

FIG. 3 illustrates another embodiment of the physical conditioning device (10) wherein the upper boom mount (22) and lower boom mount (24) are slidably engaged with the shaft (12). This engagement permits the booms (18 and 20) to move along the longitudinal axis of the shaft (12) to allow the drag chute (16) to capture more air as the physical conditioning device (10) is being utilized by the user. Lower stops (28*a* and 28*b*) and upper stops (30*a* and 30*b*) limit the range of movement of the lower boom (20) and upper boom (18), respectively, along the shaft (12). The stops may be formed into the shaft (12). The stops may also be in the form of clamps, O-rings, or any other device capable of fixed or moveable attachment to a cylindrical apparatus. In some embodiments, the positions of the stops (28*a*, 28*b*, 30*a*, and 30*b*) may be adjusted by the user to vary the resistance provided by the physical conditioning device (10).

FIG. 3 also illustrates the use of elastic members (32*a* and 32*b*) attached to the edge of the drag chute (16) to allow the drag chute (16) to expand while in operation. This expansion causes the drag chute (16) to capture more air and to exert more resistance during the swing.

Figure 4:
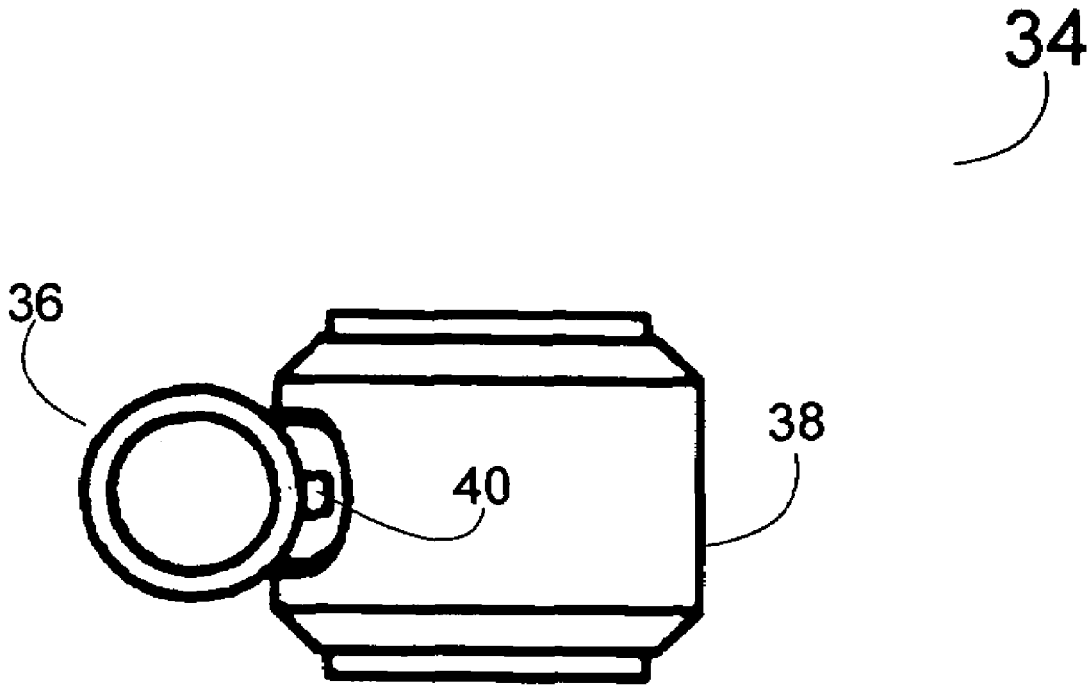
FIG. 4 is a side view of a boom mount.

FIG. 4 provides a detailed side view of a boom mount (34). A boom (18 and 20) is attached to the boom mount (34) via boom collar (36). The boom mount (34) is attached, either fixedly or slidably, to the shaft (12) vial shaft collar (38). The boom collar (36) and shaft collar (38) are in pivotal engagement via collar pivot (40).

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the disclosure will cover such modifications that fall within the scope of the invention.

The invention claimed is:

1. A physical conditioning apparatus for golf, the apparatus comprising:

a shaft having a longitudinal axis with a grip at a butt end thereof;

an upper boom attached to the shaft;

a drag chute with a first end and a second end, the first end of the drag chute attached to the first upper boom; and a lower boom, wherein the second end of the drag chute is attached to the lower boom, each upper and lower boom adapted to independently slide up or down along the longitudinal axis of the shaft to capture more or less air in the drag chute.

2. The physical conditioning apparatus of claim 1 wherein each upper and lower boom is adapted to pivot parallel to the longitudinal axis of the shaft.

3. The physical conditioning apparatus of claim 1 where each upper and lower boom is adapted to fold parallel to the shaft at the point where each upper and lower boom is attached to the shaft.

4. The physical conditioning apparatus of claim 1 wherein each upper and lower boom is adapted to rotate about the longitudinal axis of the shaft.

5. The physical conditioning apparatus of claim 1 wherein the shaft is tapered.

6. The physical conditioning apparatus of claim 1 further comprising stopping means to limit the movement of the upper and lower booms along the length of the shaft.

7. The physical conditioning apparatus of claim 1 further comprising a weight removably attached to a tip end of the shaft opposite the butt end.

8. The physical conditioning apparatus of claim 1 wherein the edges of the drag chute are comprised of elastic material.

9. A physical conditioning apparatus for golf, the apparatus comprising:

a shaft with a grip at a butt end thereof;

a first boom and a second boom;

a first pivoting boom mount attached to the first boom at the center point of the first boom and a second pivoting boom mount attached to the second boom at the center point of the second pivoting boom wherein the first and second boom mounts are engaged with the shaft, the boom mounts being adapted to rotate about the longitudinal axis of the shaft and comprising a pivot mechanism to allow the first and second booms to pivot parallel to the longitudinal axis of the shaft;

a first bushing and a second bushing disposed between the shaft and the first boom mount and second boom mount to facilitate rotational movement; and a drag chute with a first end and a second end, the first end of the drag chute being attached to the first boom and the second end of the drag chute being attached to the second boom.

10. A physical conditioning apparatus for golf, the apparatus comprising:

a shaft with a grip at a butt end thereof;

a first boom and a second boom;

a first pivoting boom mount attached to the first boom at the center point of the first boom and a second pivoting boom mount attached to the second boom at the center point of the second boom wherein the first and second boom mounts are adapted to independently slide up or down along the shaft, the boom mounts being adapted to rotate about the longitudinal axis of the shaft and comprising a pivot mechanism to allow the first and second booms to pivot parallel to the longitudinal axis of the shaft;

stop members to limit independent movement of the first and second booms along a length of the shaft;

a drag chute with a first end and a second end, the first end of the drag chute attached to the first boom and the second end of the drag chute attached to the second boom, wherein the edges of the drag chute are comprised of elastic material; and a weight removably attached to a tip end of the shaft opposite the butt end.

11. A physical conditioning apparatus for golf, the apparatus comprising:

a tapered shaft with a length between 30 and 45 inches and a grip at the butt end thereof and an outer diameter that varies between 0.335 inches at a tip end and 0.620 inches at the butt end;

a weight, with mass between 4 ounces and 16 ounces, removably attached to the tip end of the shaft, the weight being in threaded engagement with the tip end of the shaft;

a first boom with a first and second hub;

a second boom with a first and second hub;

a first pivoting boom mount attached to the first boom at the center point of the first boom and a second pivoting boom mount attached to the second boom at the center point of the second boom wherein the first and second boom mounts are adapted to independently slide up or down along the shaft, the boom mounts being adapted to rotate about the longitudinal axis of the shaft and comprising a pivot mechanism to allow the first and second booms to pivot parallel to the longitudinal axis of the shaft;

stop members engaged with the shaft to limit the independent movement of the first and second boom mounts along the length of the shaft, the positions of the stop members being adjustable to allow for variable lengths of travel by the boom mounts; and a rectangular drag chute with a first end, a second end, a first side and a second side, the first end of the drag chute attached to the first and second hub of the first boom and the second end of the drag chute attached to the first and second hub of the second boom, wherein the first side and the second side of the drag chute are comprised of elastic material.

* * * * *